United States Patent [19]

Hirozawa

[11] 3,988,223

[45] Oct. 26, 1976

[54] UNPLUGGING OF ELECTROLYSIS DIAPHRAGMS

[75] Inventor: Stanley T. Hirozawa, Birmingham, Mich.

[73] Assignee: BASF Wyandotte Corporation, Wyandotte, Mich.

[22] Filed: Oct. 28, 1975

[21] Appl. No.: 626,488

[52] U.S. Cl. ..... 204/98; 204/128; 204/295; 204/296

[51] Int. Cl.[2] ..... C25B 1/16; C25B 1/26; C25B 15/08; C25B 13/00

[58] Field of Search ..... 204/296, 295, 128, 98

[56] References Cited

UNITED STATES PATENTS 3,630,863 12/1971 Jeffery et al. ..... 204/296

*Primary Examiner*—R. L. Andrews

*Attorney, Agent, or Firm*—Bernhard R. Swick; Arnold S. Weintraub; Robert E. Dunn

[57] ABSTRACT

The diaphragm of a chlor-alkali cell has its useful life prolonged by the unplugging thereof. Unplugging is achieved by shifting the pH gradient in the diaphragm toward the catholyte side. Simultaneously with the shifting of the pH gradient, chelates are formed in the anolyte solution from α-hydroxyketones and α-hydroxyaldehydes.

7 Claims, 2 Drawing Figures

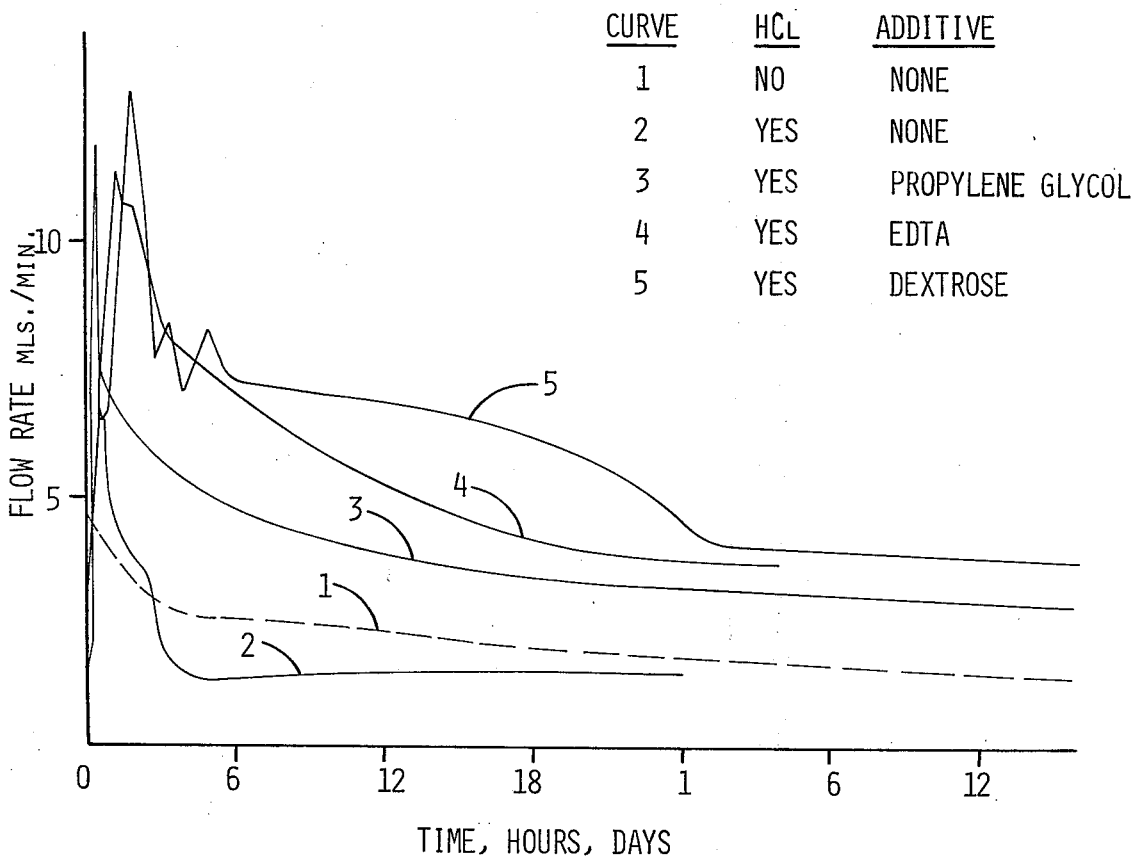
Fig-1
Fig-2
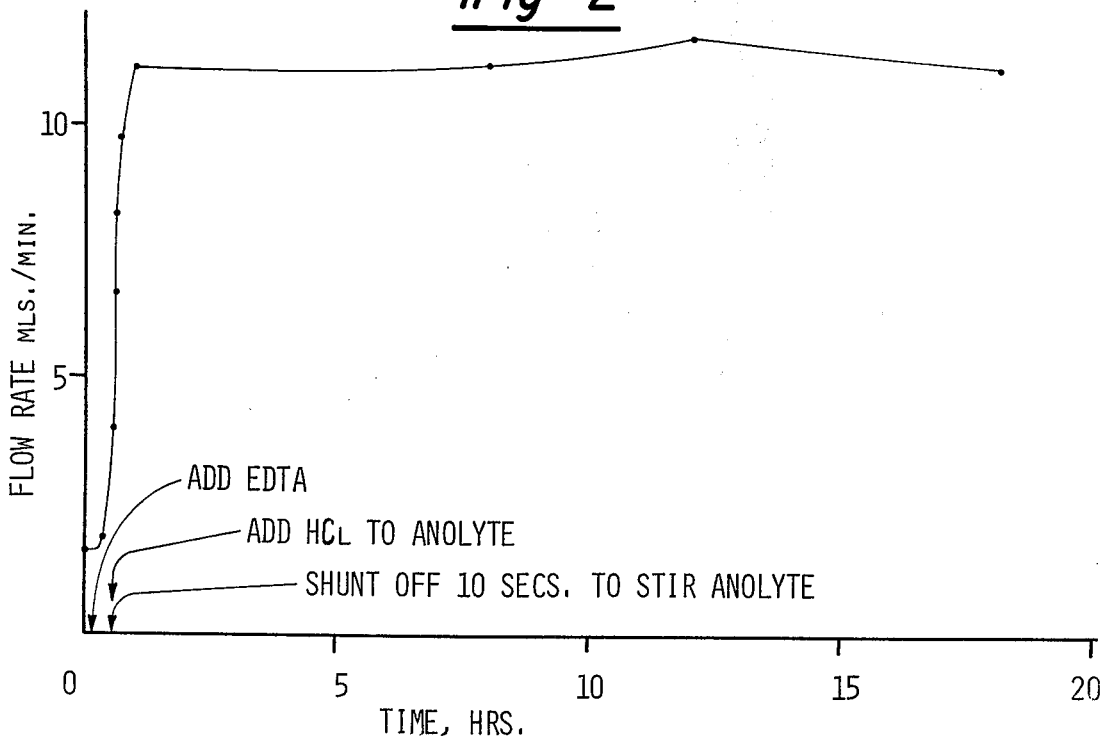

UNPLUGGING OF ELECTROLYSIS DIAPHRAGMS

BACKGROUND OF THE INVENTION

1. Field of the Invention

The present invention pertains to chlor-alkali cells used for the manufacture of chlorine and caustic. More particularly, the present invention pertains to means and methods for prolonging the useful life of diaphragms employed in chlor-alkali cells. Even more particularly, the present invention pertains to means and methods for unplugging the diaphragms used in chlor-alkali cells to thereby prolong the useful life of the diaphragm.

2. Prior Art

As is known to those skilled in the art to which the invention pertains, one of the more essential requirements during chlor-alkali cell operation is the maintenance of optimum diaphragm permeability. Maintenance of diaphragm permeability is most crucial where synthetic diaphragms are employed, especially those diaphragms formed from chemically stable perfluorinated compounds, such as those sold commercially under the names NAFION and GORE-TEX. When the permeability of the diaphragm falls below an accepted minimum, cell operation must be terminated and the diaphragm must be renewed or replaced.

In seeking maintenance of the permeability of the diaphragm, it is greatly more desirable to renew or rejuvenate a diaphragm than to replace the diaphragm. Thus, the prior art has recognized that a reduction in the permeability of the diaphragm is caused by the plugging thereof. The plugging is attributable to the accumulation of acid- and base- insoluble solids which arise as a result of degradation of the cell structural materials in the anolyte and by the precipitation of cationic impurities in the brine, e.g. hydroxides, carbonates and the like, which may be present in the anolyte. The former type of accumulation is referred to as "irreversible plugging." The latter type of accumulation is referred to as "reversible plugging" because the precipitates can be redissolved by chemical treatment.

It is to be appreciated that mere chemical treatment, alone, to dissolve the precipitates is insufficient since the dissolved cations in solution must be transported across the diaphragm against a flux of hydroxide ions. If the pH in the diaphragm is sufficiently high, certain of the dissolved cations, e.g. ferric and magnesium ions, could be reprecipitated. Thus, the prior art has sought and proposed ways of rejuvenating a diaphragm while concommitantly overcoming the problems alluded to herein. For example, in U.S. Pat. No. 3,630,863 there is taught the electrical disconnection and brine flow shut-off of a chlor-alkali cell followed by the introduction into the anolyte of gluconic acid or a similar water soluble hydroxy carboxylic compound.

In U.S. Pat. No. 3,467,586 there is taught the rejuvenation of a diaphragm by a process comprising brine flow shut-off, electrical disconnection of the cell, drainage of the cell and the acid treatment of the diaphragm. Useful acids include hydrochloric acid, acetic acid, formic acid, sulfuric acid and the like. U.S. Pat. No. 583,330 teaches the addition of hydrochloric acid directly to the anolyte during electrolysis. Other background art may be found in U.S. Pat. No. 3,485,730.

The present invention, on the other hand, permits the rejuvenation of a diaphragm while obviating the need for shutting down the cell.

SUMMARY OF THE INVENTION

In accordance with the present invention the permeability of a plugged electrode is increased by a process which comprises:

a. maximizing the brine head,
b. adding a chelate or chelate forming agent to the anolyte,
c. shunting the current to the cell,
d. flushing the cell, and
e. removing the shunt.

Optionally, intermediate the shunting and flushing steps hydrochloric acid is added to the anolyte with stirring. Also, the hydrochloric acid may be added with the chelate or chelate former.

The chelate or chelate former cooperates with the anolyte, which is an oxidant, to synthesize, in situ, monobasic and dibasic polyhydroxyacids from monosaccharides, disaccharides, trisaccharides, deoxyaldoses, ketoses, sugar alcohols, polysaccharides and the like. Thus, the useful chelates are those which have an $\alpha$- or $\beta$-hydroxyl carboxylic group. The useful chelate formers are those compounds which exist as, or which can form under acid hydrolysis, a compound having one or more hydroxyl groups adjacent to an aldo- or keto- group.

The chelate or chelate former is generally employed in an amount ranging from about 100 to about 10,000 parts by weight thereof per one million parts by weight of anolyte (ppm). Preferably, from about 250 to 5000 ppm of chelate or chelate former is employed.

For a more complete understanding of the present invention, reference is made to the following detailed description and accompanying examples.

DESCRIPTION OF THE PREFERRED EMBODIMENTS

In accordance with the present invention, a diaphragm mounted in a chlor-alkali cell has the permeability thereof increased by a process for unplugging the diaphragm. The process hereof, generally, comprises:

a. maximizing the brine head,
b. adding a chelate or chelate former to the anolyte,
c. shunting the electrical current to the cell,
d. flushing the cell, and
e. removing the shunt.

Depending on the degree of plugging of the diaphragm, intermediate the shunting and flushing steps of the process, or contemporaneous with the addition of the chelate or chelate former, hydrochloric acid may be added to the anolyte, with stirring.

The present invention, although generally applicable to all types of diaphragms in both monopolar and bipolar cells, as well as membrane cells, has been found to be particularly effective in unplugging synthetic resinous diaphragms and, in particular, diaphragms formed from chemically stable perfluorinated compounds. Such perfluorinated-based diaphragms are known. The chemically stable perfluorinated compounds are commercially available and sold under a plurality of names, for example, NAFION and GORE-TEX.

As noted above, the first step in the process comprises maximizing the brine head. This increases the brine flow rate which, in turn, shifts the pH gradient toward the catholyte. The maximum brine head available to any cell is dependent upon the cell size and its structure.

After the brine head is maximized there is, then, added to the anolyte a chelate or chelate former. The chelate or chelate former is essential hereto in that a chelated cation minimizes any tendency of the cation to reprecipitate in the diaphragm. The addition of the chelate former takes advantage of the acidic oxidizing anolyte medium to hydrolyze polysaccharides into simple sugars and to oxidize the latter to synthesize polyhydroxyacids in situ. Generally, the chelate or chelate former is employed in an amount ranging from about 100 to 10,000 parts by weight thereof per one million parts by weight of anolyte (ppm). Preferably, the chelate or chelate former is employed in an amount ranging from about 250 to 5,000 parts by weight thereof per one million parts by weight of anolyte.

In synthesizing the polyhydroxyacids in situ, it is preferred that monobasic and dibasic acids, i.e. glyconic and glycaric acid, respectively, be formed. The chelate former can comprise any compound which exists as, or which can form, under acid hydroylsis, a compound with one or more hydroxyl groups adjacent to an aldo- or keto- group. Thus, the chelate formers are, preferably, α-hydroxyketones or α-hydroxyaldehydes or compounds which yield α-hydroxyketones or -aldehydes under acid hydrolysis.

Representative of the chelate formers useful in the practice hereof include monosaccharides, disaccharides, trisaccharides, deoxyaldoses, ketoses, sugar alcohols,, polysaccharides and the like, as well as mixtures thereof.

Representative of the monosaccharides are, for example, glucose, dextrose, mannose, galactose, arabinose, xylose, ribose and the like, as well as mixtures thereof. Useful disaccharides include maltose, lactose, cellobiose, sucrose, and the like. Representative of a useful trisaccharide is raffinose. Useful dioxyaldoses include rhamnose and fucose. Useful ketoses include fructose, sorbose, ribulose, and the like. Sugar alcohols include sorbitol, mannitol, and the like. The term polysaccharide includes starch, cellulose, and the like.

It is to be appreciated that simple sugars can be derived from the above compounds.

Representative of the chelates which can be used herein are, for example, ammoniadiacetic acid; ammoniadipropionic acid; ammoniatriacetic acid; ammoniatripropionic acid; 2-sulfoanilinediacetic acid; 1,2-diaminocyclohexane, N,N'-tetraacetic acid; ethylenediamine tetraacetic acid (EDTA); ethylenediamine tetrapropionic acid; trimethylenediamine tetraacetic acid; tetramethylenediamine tetraacetic acid; pentamethylenediamine tetraacetic acid; 2-hydroxycyclohexylimino diacetic acid; N'-(2-hydroxyethyl)ethylenediamine-N,N,N'-triacetic acid, and the like. Because of the limited solubility of the acids in water, it is preferred to employ the salts of these acids. Usually, the sodium salt of the acid is employed.

Other useful chelates include glycaric acids, such as galactaric acid, mannaric acid, and the like, and glyconic acids, such as gluconic acid, galactonic acid, and the like.

Other effective chelates are those having a lesser number of carbon atoms than those enumerated above, but which have the essential α- and/or β-hydroxyl carboxylic groups. Such chelates are particularly effective against transition element ions, e.g. $Fe^{+++}$. Chelates having a basic —N— group in a position to permit a five membered chelate are particularly effective in unplugging a diaphragm having a large concentration of alkaline earth cations. Such chelates complex with the alkaline earth cations, for example, in the following manner:

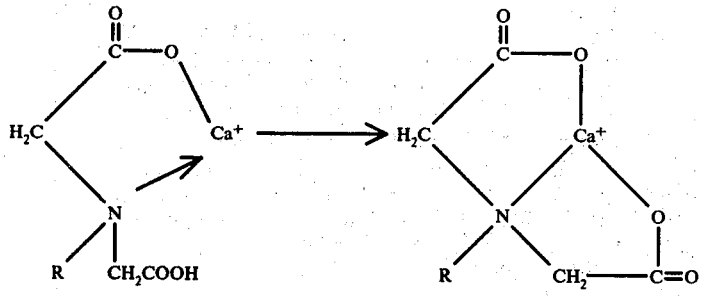

Representative of this latter type of chelate are, for example, β-aminoethylphosphonic acid, N,N-diacetic acid; β-aminomethylphosphonic acid, N,N-diacetic acid and β-aminoethylsulphonic acid, N,N-diacetic acid.

Still another useful chelate former is propylene glycol.

Preferred chelates are EDTA; N'-(2-hydroxyethyl) ethylenediamine-N,N,N'triacetic acid; gluconic acid, as well as mixtures thereof.

Preferably, after the chelate or chelate former is added to the anolyte, by any suitable mode, such as the direct addition thereof, the cell is shunted to reduce the current down to about five to ten percent of full current. This is achieved by shunting the electrical current thereacross by any suitable means, such as a nichrome wire or the like. By shunting the current across the cell, the hydroxide flux is decreased. A decrease in the hydroxide flux shifts the pH gradient toward the catholyte. This reduced current prevents the corrosion or rusting of the cathode during the unplugging process. The cell may be shunted, also, either before or concurrently with the addition of the chelate or chelate former. However, it is preferred to shunt the cell after the addition step. Conventionally, a chlor-alkali cell is run on a current density of about two hundred amps per square foot (ASF). In accordance herewith, the shunt decreases the current density to about eight to sixteen ASF.

After the shunt is placed across the cell, the cell is, then, flushed. Nominally, flushing takes place over a time period of from about one to three hours. However, the flushing period may vary depending on the porosity of the diaphragm of which flushing is a function. By flushing the cell a substantial portion of the cationic impurities therewithin are eliminated. The flushing step flushes out anolyte through the diaphragm until the dissolved impurities are eliminated or sufficiently diluted. Flushing is achieved by passing brine or water, preferably brine, through the diaphragm to the catholyte side thereof. Any suitable means can be utilized to effectuate flushing. To avoid a long flush time, the treated brine may be simply replaced by fresh brine.

After the flushing is completed the shunt is removed and the cell is returned to full power. By applying full current across the diaphragm the unplugging of the cell diaphragm is completed.

As hereinbefore noted, optionally, intermediate the shunting and flushing of the cell, hydrochloric acid may be added to the anolyte, with stirring. The hydrochloric acid addition serves three functions. First, the hydrochloric acid dissolves the precipitates. In connection with the dissolving ability, the tunneling capability of the protons, i.e. $H^+$, renders the hydrochloric acid efficacious in unplugging tiny pores in the diaphragm. A second function of the hydrochloric acid is that it catalyzes the transformation of the sugars produced by the chelate former, where used, from the stable acetals and hemiacetals to the more readily oxidized aldehydes. Thirdly, the hydrochloric acid moves the pH gradient towards the catholyte. The hydrochloric acid is added to the anolyte by any conventional mode. Generally, six molar hydrochloric acid is employed. It should be noted that, where used, the hydrochloric acid can be added to the anolyte contemporaneously with the chelate or chelate former. In order to stir the hydrochloric acid, the shunt is removed, in the manner heretofore described for about thirty seconds. It should, also, be noted that the hydrochloric acid can not be added to the anolyte prior to the chelate or chelate former since further plugging of the diaphragm would occur. The hydrochloric acid is added to the anolyte in an amount ranging from about 400 to 20,000 ppm, and preferably, from about 4,000 to 10,000 ppm.

It should be noted with respect to the present invention that shunting of the cell, alone, could improve the permeability of the diaphragm. For example, with a fresh, clean cell diaphragm there is no significant change in diaphragm permeability when the current density is decreased from about two hundred ASF to about ten ASF. Furthermore, a moderately plugged diaphragm which is operated for about one to two weeks will show an increase in permeability by the shunting of the cell. However, a severely plugged diaphragm operated for two to three months shows a further decrease in permeability by shunting, alone.

Following are specific, non-limiting examples of the present invention. In the examples, all parts are by weight absent indications to the contrary. Also, in the examples, the flow rate through the tested diaphragms was defined in terms of permeability in accordance with the following equation:

$$P = \frac{(\text{flow rate, mls/min})\ (0.2543)}{(\text{electrode area, ft}^2)\ (\text{brine head, in})} 1\ \text{hr}^{-1}\text{m}^{-2}\text{cm}^{-1}$$

wherein 0.2543 is a constant which converts the English units to metric units.

EXAMPLE I

A diaphragm formed from NAFION was installed in a test chlor-alkali cell and the cell was put into operation. The brine feed into the cell was a "spiked" high hardness brine containing about 25 ppm of calcium ion and about five ppm magnesium ion. At a constant brine head of 18 inches, the flow rate decreased from an initial rate of 4.4mls/min. to 1.26 mls/min. The current density was then changed from 160 ASF to 40 ASF by shunting the cell. Six molar hydrochloric acid was then added to the anolyte at the rate of 15 drops per minute. After about one-quarter hour, the acid addition was terminated, and the shunt removed. After an initial unplugging, the flow rate through the diaphragm decreased rapidly and within six hours the flow rate had returned to the plugged rate of about 1.26 mls/min.

Thus, it was established that acid addition and shunting was ineffective in unplugging a diaphragm for extended periods of time.

EXAMPLE II

To confirm the results reached in Example I, the test cell thereof was continued to be operated for an additional week with the high hardness brine. After the one week period the diaphragm was severely plugged. Then, the procedure of Example I was repeated by shunting the cell and adding six molar hydrochloric acid to the anolyte. The same results were observed.

It appeared from the results of Examples I and II that the precipitates on the surface of the diaphragm were dissolved, but reprecipitated in the diaphragm.

EXAMPLE III

This example illustrates the effects accruing to acid addition followed by chelate or chelate former addition to the anolyte, using the high hardness brine defined in Example I.

The diaphragm utilized in Examples I and II was allowed to become plugged. It was then unplugged by shunting the current accompanied by the addition of six molar hydrochloric acid in the manner described in Example I. Soon after unplugging the diaphragm, there was then added to the anolyte propylene glycol. The propylene glycol was added to the anolyte by the direct and continuous addition thereof to the brine feed. The concentration of propylene glycol was maintained at one thousand ppm. The maintenance of the concentration was continued until the permeability of the diaphragm reduced and the diaphragm became plugged.

After the diaphragm became plugged, the experiment was repeated, but utilizing a one thousand ppm concentration of ethylene diamine tetraacetic acid in lieu of propylene glycol. The concentration was maintained until the diaphragm, again, became plugged. To unplug the diaphragm, there was introduced into and maintained in the brine, a one thousand ppm concentration of dextrose. The dextrose treatment was continued until the diaphragm, again, became plugged.

The results of these experiments are depicted in the graph of FIG. 1. From the graph it is seen that hydrochloric acid treatment followed by chelate or chelate former treatment unplugs the diaphragm. However, the diaphragm re-plugs shortly thereafter. Furthermore, it is seen from the graph that dextrose is more effective than EDTA which is more effective than propylene glycol in retarding plugging.

EXAMPLE IV

In order to confirm the results reached in Example I, but without a "spiked" brine, a test was run to determine the unplugging capabilities of hydrochloric acid, alone.

A diaphragm formed from a chemically stable perfluorinated compound sold under the name GORE-TEX was disposed in a test chlor-alkali cell. The diaphragm, in its plugged state, evidenced a flow rate of 2.42 mls/minute. The brine head was maximized to eighteen inches and the current was shunted, as hereinbefore described in Example I. There was then added to the anolyte, by dropwise addition, six molar hydrochloric acid at the rate of fifteen drops per minute. However, instead of evidencing a sharp unplugging maxima, followed by a rapid re-plugging, the plugging of the diaphragm became worse. The addition of two 10 milliliter doses of the hydrochloric acid contemporaneous with the continued dropwise addition thereof did not affect the plugged state of the diaphragm. Thus, the ineffectiveness of hydrochloric acid in restoring and maintaining the permeability of the diaphragm was once again established.

EXAMPLE V

To establish the efficacy of the present invention, a test chlor-alkali cell having a GORE-TEX diaphragm disposed therein was permitted to become plugged under normal operating conditions.

After maximizing the brine head, there was then added to the anolyte forty mls of 0.1M EDTA. The cell was then shunted to a current density of about 10 ASF. Approximately one-half hour after the addition of the EDTA, twenty mls of 6M hydrochloric acid was added to the anolyte, with stirring. Stirring was achieved by removing the shunt for about 10 seconds. The cell was flushed with brine and the shunt was removed.

From the graph, denoted as FIG. 2, it is seen that by employing the steps of the process, not only is the diaphragm unplugged, but also, rapid re-plugging is obviated.

The following three examples illustrate the unplugging effect achieved by only the addition of a chelate or chelate former.

EXAMPLE VI

A plugged perfluorinated diaphragm formed from NAFION was operating in the test cell heretofore described. The permeability thereof was 0.49, as determined in accordance with the equation set forth above.

Without shunting the cell, and after maximizing the brine to an eighteen inch head, the anolyte was treated, through the brine feed with sucrose. The sucrose was added in an amount to bring the concentration thereof in the anolyte to one thousand ppm. The permeability of the diaphragm increased to 0.71 in nine minutes, without the addition of hydrochloric acid. Thus, the addition of the chelate former, alone, was ineffective in sufficiently unplugging the diaphragm to be effective, in and of itself.

EXAMPLE VII

A plugged perfluorinated diaphragm formed from GORE-TEX and disposed in a test chlor-alkali cell had a permeability of 0.32. After maximizing the brine head, a shunt was placed across the cell to reduce the current density to about ten ASF. To the anolyte was then added a dosage of fructose to render the concentration thereof in the anolyte at 8700 ppm. After flushing the cell and removing the shunt the permeability of the diaphragm increased to about 1.95 and then levelled off to about 1.7 and remained thereat for about ten hours when the test was terminated.

EXAMPLE VIII

Using a diaphragm, such as that utilized in Example VII, and having a permeability of 0.34, to the anolyte of the cell was added sufficient lactose to bring the concentration thereof in the brine to 7000 ppm. The lactose was added after maximizing the brine head. After the lactose was added, the cell was shunted and the current density reduced to about ten ASF. The cell was then flushed with brine and the permeability of the diaphragm was observed and recorded. Without removing the shunt the permeability of the diaphragm increased steadily to 2.0 after four and one-half hours without any evidence of any decrease in the permeability.

With respect to Examples VII and VIII, it was noted that in several instances where the diaphragm was severely plugged and the salt cut high, treating the diaphragm with only a simple sugar was ineffective. In such instances with a high salt cut, the anolyte is slightly basic. In a neutral or basic medium, the cyclic acetal form of the sugar is quite stable and therefore does not form an acid under hydrolysis. Thus, it is theorized that the anolyte in Examples VII–VIII was sufficiently acidic, without hydrochloric acid addition, to yield hydroxyacids and hydrochloric acid in the anolyte. This is exemplified by the following reaction:

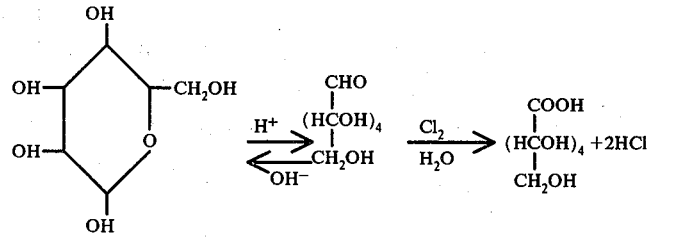

HEMIACETAL ALDEHYDE GLYCONIC ACID

Thus, under the conditions of the anolyte in Examples VII–VIII no hydrochloric acid was added, but was internally generated with the contemporaneous formation of the desired monobasic polyhydroxyacid.

EXAMPLE IX

In this example the effects of the brine head and current density on the unplugging procedure are illustrated. In this example the pH of the anolyte is lowered, i.e. shifted toward the catholyte, prior to observing the desired effects.

A plugged GORE-TEX diaphragm disposed in a chlor-alkali cell had a permeability of 0.45. After maximizing the brine head to about 16 inches, three mls of a solution of fifty percent gluconic acid was added to the anolyte. A shunt was placed across the cell to reduce the current density from 200 ASF to 10 ASF. Immediately thereafter an additional two mls. of the gluconic acid solution was added to the anolyte. After waiting about one-half hour, twenty mls. of six molar hydrochloric acid was added to the anolyte and the shunt was disconnected for about thirty seconds to stir the hydrochloric acid. The shunt was then re-connected. The flushing of the cell was then commenced by the introduction of fresh brine into the anolyte compartment. At the point of commencement of flushing, the permeability of the diaphragm was about 2.05. One-half hour after commencing the flushing, the shunt was disconnected thereby increasing the current density to 200 ASF. Two-tenths of an hour later, the brine head was reduced from the 16 inch head to 9 inches, then to 5 inches one-quarter of an hour later. The permeability of the diaphragm drastically reduced to 0.63 at 1.0 hours after removing the shunt. At this time the shunt was re-connected and five additional mls. of the 50% gluconic acid solution was added to the anolyte. This restored the permeability to about 1.9. However, at 1.2 hours the permeability dropped to about 0.95. The brine head was then restored to sixteen inches and the permeability rose to 1.6. Three hours later the head was dropped to fourteen inches and the permeability dropped to 1.38. The head was then restored to sixteen inches and the shunt was turned off. The permeability rose to about 1.9 about one-half hour later. After an additional one-half hour the brine head was lowered to 9 inches. The entire process taking place over a period of about 5.3 hours after commencing flushing. When the brine head was reduced to nine inches the last time, there was no precipitous drop in the permeability thereby indicating that the cell had reached the pH level of a clean cell, i.e. 3.5±1.0, and the diaphragm had been unplugged and rejuvenated.

It is to be appreciated from a consideration of the examples that the efficacy of the present process has been successfully established.

Having, thus, described the invention what is claimed is:

1. A method for unplugging a diaphragm in a chlor-alkali cell, comprising:

a. maximizing the head of the brine feed, b. adding a chelate or a chelate former to the anolyte, the chelate being selected from the group consisting of compounds having an - or -hydroxyl carboxylic group and the chelate former being selected from the group consisting of 1. a compound which exists, under acid hydrolysis as a compound having one or more hydroxyl groups adjacent to an aldo- or keto- group and
2. a compound which can form, under acid hydrolysis, a compound having one or more hydroxyl groups adjacent to an aldo- or keto- group, c. shunting the cell current, either before contemporaneous with or after the addition of the chelate or chelate former to reduce the current in the cell to about five to ten percent of normal operating current, d. flushing the cell, and e. removing the shunt.

2. The method of claim 1 wherein the chelate former is selected from the group consisting of α-hydroxyaldehydes, α-hydroxyketones and mixtures thereof.

3. The method of claim 2 wherein the chelate former is selected from the group consisting of monosaccharides, disaccharides, trisaccharides, deoxyaldoses, ketoses, sugar alcohols, polysaccharides and mixtures thereof.

4. The method of claim 3 wherein the chelate former is selected from the group consisting of glucose, dextrose, mannose, galactose, arabinose, xylose, ribose, maltose, lactose, cellobiose, sucrose, raffinose, rhamnose, fucose, fructose, sorbose, rebulose, sorbitol, mannitol, starch, cellulose and mixtures thereof.

5. The method of claim 1 which further comprises: adding hydrochloric acid to the anolyte contemporaneous with the addition of the chelate or chelate former or intermediate the shunting of the cell and the flushing of the cell.

6. The method of claim 1 wherein the chelate or chelate former is employed in an amount ranging from about 100 to about ten-thousand parts by weight thereof per one million parts by weight of anolyte.

7. The method of claim 1 wherein the chelate is selected from the group consisting of ammoniadiacetic acid; ammoniadipropionic acid; 2-sulfo-aniline diacetic acid; ammonia triacetic acid; ammoniatripropionic acid; 1,2-diaminocyclohexane N,N′-tetraacetic acid; ethylenediamine tetraacetic acid; ethylenediamine tetrapropionic acid; trimethylenediamine tetraacetic acid; tetramethylenediamine tetraacetic acid; pentamethylenediamine tetraacetic acid; 2-hydroxycyclohexylimino diacetic acid; N′-(2-hydroxyethyl) ethylenediamine N,N,N′-triacetic acid; the sodium salts thereof; glycaric acids; glyconic acids; β-aminoethylphosphonic acid N,N-diacetic acid; β-aminomethyl phosphonic acid N,N-diacetic acid; β-aminoethylsulphonic acid N,N-diacetic acid; propylene glycol and mixtures thereof.

* * * * *